US005204069A

United States Patent [19]

Paxton et al.

[11] Patent Number: 5,204,069

[45] Date of Patent: Apr. 20, 1993

[54] RECOVERY BOILER SMELT SHATTERING SPRAY

[75] Inventors: Wendell L. Paxton; Gary W. Waddell, both of Covington, Va.

[73] Assignee: Westvaco Corporation, New York, N.Y.

[21] Appl. No.: 772,155

[22] Filed: Oct. 7, 1991

[51] Int. Cl.[5] ..... D21C 11/00

[52] U.S. Cl. ..... 422/185; 422/207; 423/DIG. 3; 162/30.1

[58] Field of Search ..... 422/185; 403/114, 90; 239/587.3, 587.2, 588; 162/29, 30.1, 30.11; 110/171; 122/7 C; 423/DIG. 3, 207; 248/230, 214, 288.3

[56] References Cited

U.S. PATENT DOCUMENTS

| | | | |
|---|---|---|---|
| Re. 8,876 | 9/1879 | Fisher | 239/587.3 |
| 557,799 | 4/1896 | Gorter | 239/587.3 |
| 2,208,126 | 7/1940 | Fitchett | 34/37 |
| 2,967,758 | 1/1961 | Thorson | 423/DIG. 3 |
| 3,122,421 | 2/1964 | Gettle | 423/DIG. 3 |
| 3,478,967 | 11/1969 | Horton et al. | 239/588 |
| 4,392,618 | 7/1983 | Evans et al. | 239/587.3 |
| 4,394,969 | 7/1983 | Jette | 239/587.3 |
| 4,659,020 | 4/1987 | Kutrow | 422/185 |
| 4,702,449 | 10/1987 | Zierhut | 248/288.3 |
| 4,723,713 | 7/1988 | Dahlquist | 239/587.2 |
| 4,761,204 | 8/1988 | Kohl et al. | 422/185 |

*Primary Examiner*—Robert J. Warden
*Assistant Examiner*—Hien Tran
*Attorney, Agent, or Firm*—R. L. Schmalz; W. A. Marcontell

[57] ABSTRACT

Nozzles for directing a jet of steam against a spout flow stream of sodium recovery boiler smelt are secured to an articulating anchor mount for the purpose of maximizing the shattering impact of the steam jet upon the smelt flow stream under a wide range of boiler operating conditions.

14 Claims, 3 Drawing Sheets

RECOVERY BOILER SMELT SHATTERING SPRAY

BACKGROUND OF THE INVENTION

Field of the Invention

The present invention relates to soda recovery boilers as are used by the wood pulping industry. In particular, the invention is directed to shatter steam sprays for dispersing flow streams of smelt emerging from the boiler bed.

Description of the Prior Art

Pursuant to present-day paper pulp mill operations, raw wood is delignified by a thermo-chemical process comprising an approximately 350° F. cook in the presence of sodium hydroxide, sodium carbonate, sodium sulfide and other sodium based compounds. Under such conditions, the lignin binder in the raw wood matrix which holds the natural cellulose fibers together reacts with the sodium compounds to form water soluble lignin-sodium complexes thereby permitting a water wash separation of the black, tar-like lignin from the fiber for manufacture of paper.

Although the sodium compounds used in the aforedescribed process are relatively inexpensive, the quantities consumed in the production of an average pulp mill necessitate an economical recovery and re-cycle of the chemical values. Moreover, such sodium-lignin complexes contain sufficient heat value and volatility to contribute favorably to the overall mill heat balance. These characteristics are combined in the liquor recovery furnace by fueling a boiler furnace with a concentrated flow stream of the spent or black pulping liquor. Combustion of the lignin fraction generates sufficient heat to evaporate the residual water vehicle and heat the steam required for the primary evaporative liquor concentration process. Residual ash, predominately sodium carbonate, falls to the furnace bed as a viscous smelt. Such smelt is cooled and dissolved in water to form the green liquor makeup stream from which the other fresh cooking liquor compounds are made.

In transition from the furnace bed to a green liquor dissolving tank, smelt flows in thin streams from numerous spouts around the furnace bed perimeter. Such smelt streams fall directly into the dissolving tank. To prevent or minimize violent chemical reactions as the sodium laden smelt combines with the aqueous green liquor, the smelt spout streams are shattered by dispersion jets of steam.

Traditionally, these shattering sprays have been rigidly secured to the furnace frame or foundation structures in such ways as to survive the extremely hot and chemically hostile conditions. Moreover, dispersion of the smelt streams notwithstanding, an irregular, low amplitude vibration continuously shakes the structure due to the sodium-water reactions.

Although the shatter sprays are rigidly mounted for survivability in a hostile environment, such rigid mounting is, in many respects, self defeating. When the spray is secured, it must be aimed at a compromise location based on the normal or average smelt flow rate. However, this smelt flow rate is unpredictably variable over a wide range. Hence, for any particular shatter spray, the fixed positionment is only occasionally correct, at best. The result is that a considerably higher level of reaction vibration occurs than is necessary.

An object of the present invention, therefore, is provision of a shatter spray mount that is adjustable.

Another object of the present invention is an adjustable shatter spray mount that will survive the hostile operating conditions.

Another object of the present invention is an articulating shatter spray mount that remains functional after months of operation in a hostile environment.

SUMMARY OF THE INVENTION

These and other objects are achieved by a shatter spray wand mounting system that includes both an articulating anchor and a single pivot axis anchor. Both anchors are spacially separated along the wand axis.

The articulating anchor is fabricated as some form of universal joint such as a ball or Cardan joint. The single pivot axis anchor is an axially extensible pedestal that may be rotated about the extension axis.

Preferably, both anchors are releasably clamped to the shatter spray wand whereby the articulation and pivot joints are immobile when the clamps are secure. Clamp release permits a limited degree of arcuate movement by the wand to the most optimum smelt shattering position. Closure of the clamps secures the wand location.

In addition to the wand anchors, the wand and anchor assembly are platform mounted on a linear adjustment carrier such as a gear rack. Rotation of a pinion from a remote location will advance or withdraw the spray wand relative to the smelt flow stream.

BRIEF DESCRIPTION OF THE DRAWINGS

Relative to the drawings wherein like reference characters designate like or similar elements throughout the several drawing figures.

DESCRIPTION OF THE PREFERRED EMBODIMENT

Figure 1:
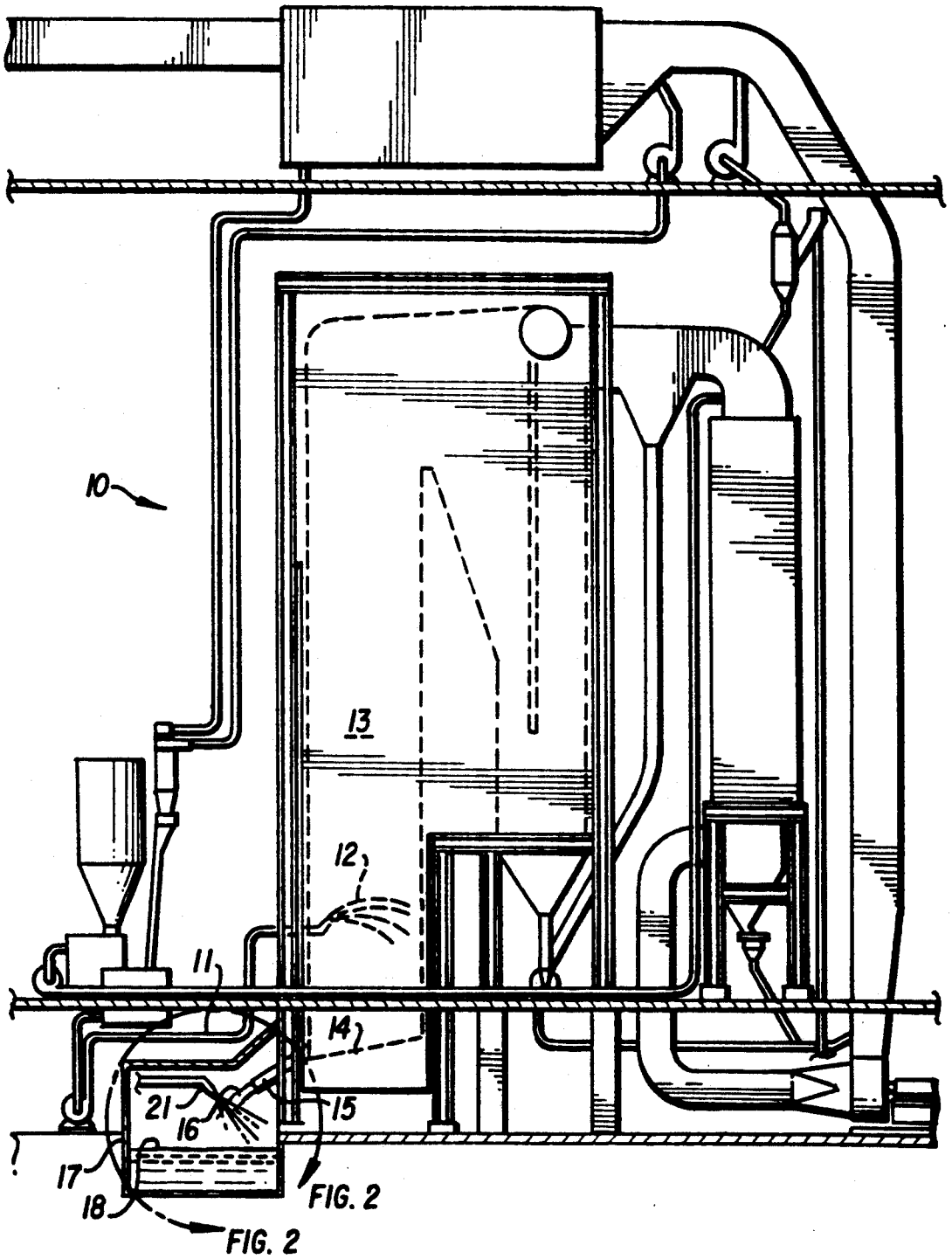
FIG. 1 is a schematic elevation of a chemical recovery boiler showing the operating environment of the invention.

For orientation of the present invention operating environment and utility, a brief description will be provided of the larger apparatus and process represented by FIG. 1. A more detailed description is readily available from many text books on the subject of soda recovery boilers for the sulphate pulp industry.

Liquid residue drained from chemically digested wood pulp is called black liquor. A 60% solids concentration of black liquor is the combustion fuel source for a steam generation facility called a recovery boiler identified, generally, by the number 10. As a fuel, black liquor comprises an aqueous solution of organic and inorganic solids. The organic constituent supports the combustion which evaporates the water and releases the inorganic constituent as an 1800° F. viscous smelt. Excess combustion heat is transferred to water boiler tubes for steam generation.

In the boiler facility, black liquor is pumped through a delivery pipe 11 for spray delivery 12 into the boiler combustion space 13. Heat and gaseous combustion products are drafted along the flue route indicated by flow arrows. Inorganic black liquor residue such as $Na_2CO_3$ and $Na_2S$ falls to the boiler bed 14 as a viscous smelt. Accumulations of the smelt are drained through smelt spouts 15 and channeled as a flow stream 16 into a dissolving tank 17. Here, the smelt is blended with a weak aqueous lye solution to formulate green liquor pool 18.

Figure 2:
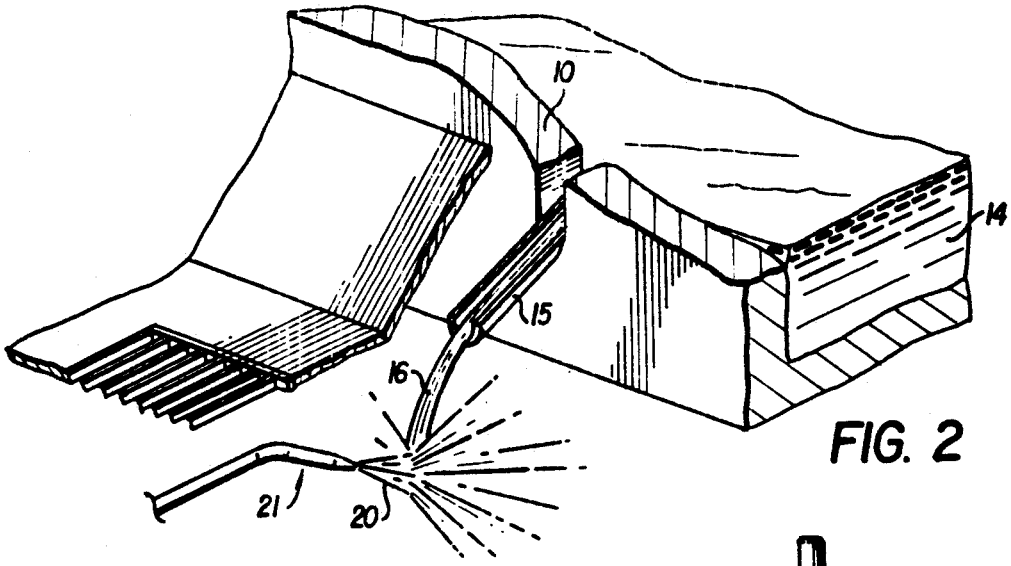
FIG. 2 is a detailed pictorial of the present invention environment.

As the smelt flow stream 16 free falls from the discharge end of spout 15, the flow stream is dispersed before reaching the green liquor pool 18 by a shattering jet of steam 20 (see FIG. 2) delivered from a shatter spray assembly 21. Such dispersion reduces the chemical reactor violence associated with an 1800° F. mass of molten sodium compound coming into sudden intimate contact with water.

Ebb and flow of the black liquor production rate and other variables within the smelt bed cause variations in the spout flow stream 16 position relative to the discharge end of the spout 15. Such ebb and flow moves the flow stream fall route toward or away from a fixed position shatter spray. For continued effect, the shatter spray assembly 21 must, therefore, be movable to accommodate these smelt flow rate variations. However, such variations are not usually abrupt. Adequate time and notice permits appropriate adjustments provided the shatter spray anchors are sufficiently clean and accessible to make such adjustments. The present invention addresses these latter circumstances.

Figure 3:
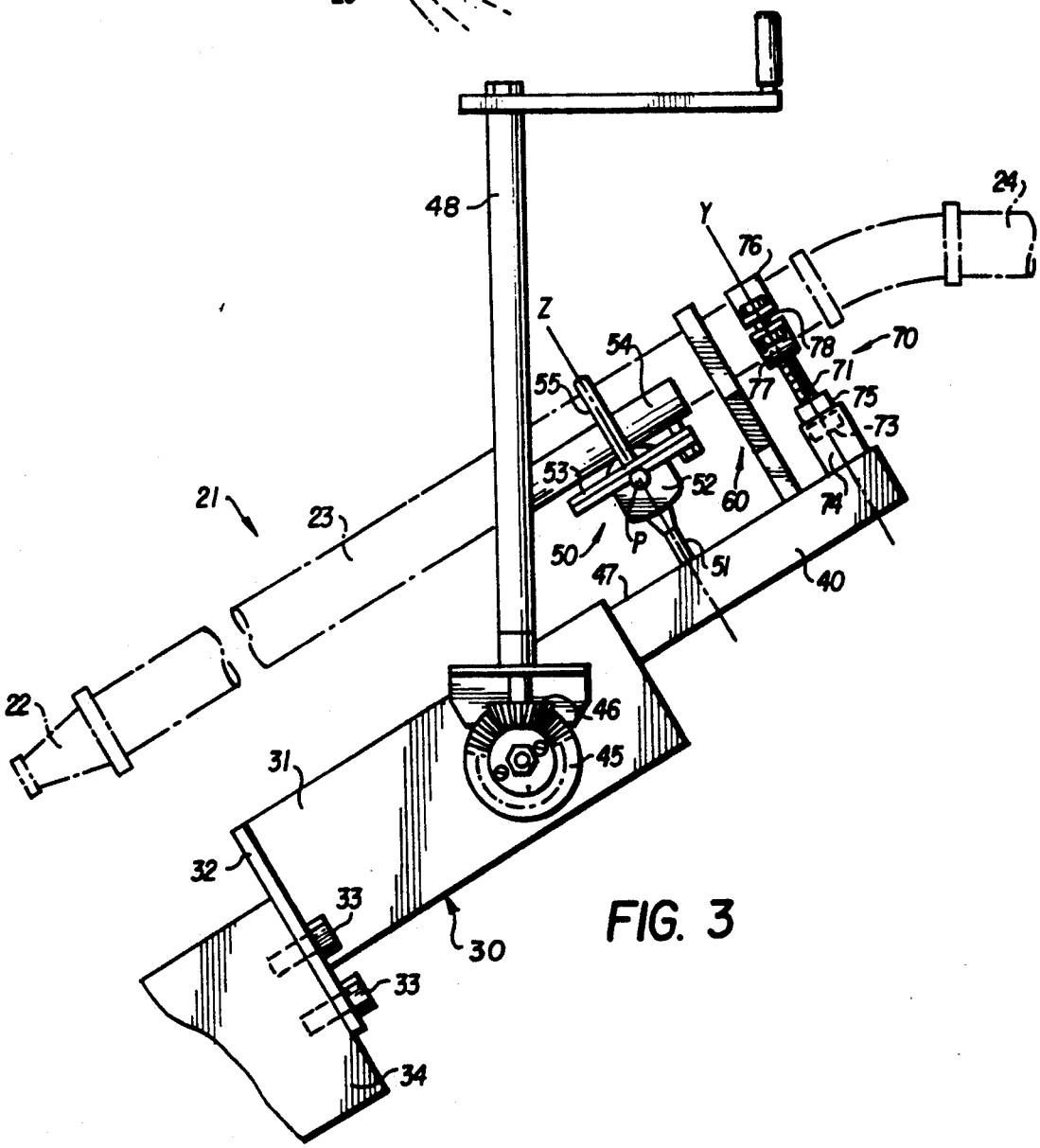
FIG. 3 is a side elevational view of the present invention.
Figure 4:
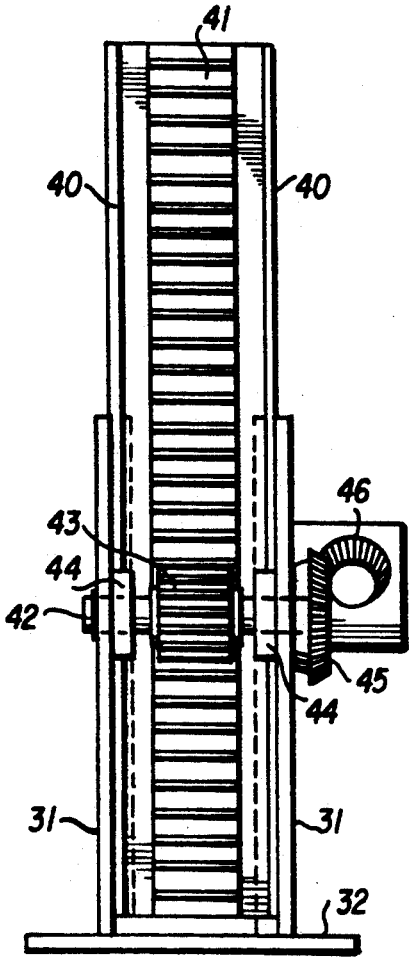
FIG. 4 is a bottom view of the present invention.

With reference to FIG. 3, a shatter spray assembly 21 comprises a steam nozzle 22 attached to the discharge end of a wand 23. At the inlet end of the wand 23 is a steam carrier conduit 24.

The steam spray assembly 21 is positionally secured by a wand mounting assembly 30 which is unitized by a frame 31 having a base mounting flange 32. Cap screws 33 secure the assembly to a rigid element 34 of the boiler support structure.

Sliding within the frame 31 along glides 35 (FIGS. 5 and 6) is a channel beam 40. Secured longitudinally to the channel beam along the trough thereof is a gear rack 41. An axle 42 mounted gear pinion 43 rotating within journal bosses 44 drives the rack and channel unit to a longitudinally selected position within the frame 31. A set of bevel gears 45 and 46 transmit manual rotation of a crankshaft 48 to the pinion 43.

To the channel beam 40 top face platform 47 are secured three fixtures 50, 60 and 70 as best seen from FIG. 3. A representative separation distance between fixtures 50 and 70 may be 20 to 25 percent of the distance from the fixture 50 to the spray nozzle 22. In the usual case, 10 to 12 inches separate fixtures 50 and 70.

Figure 6:
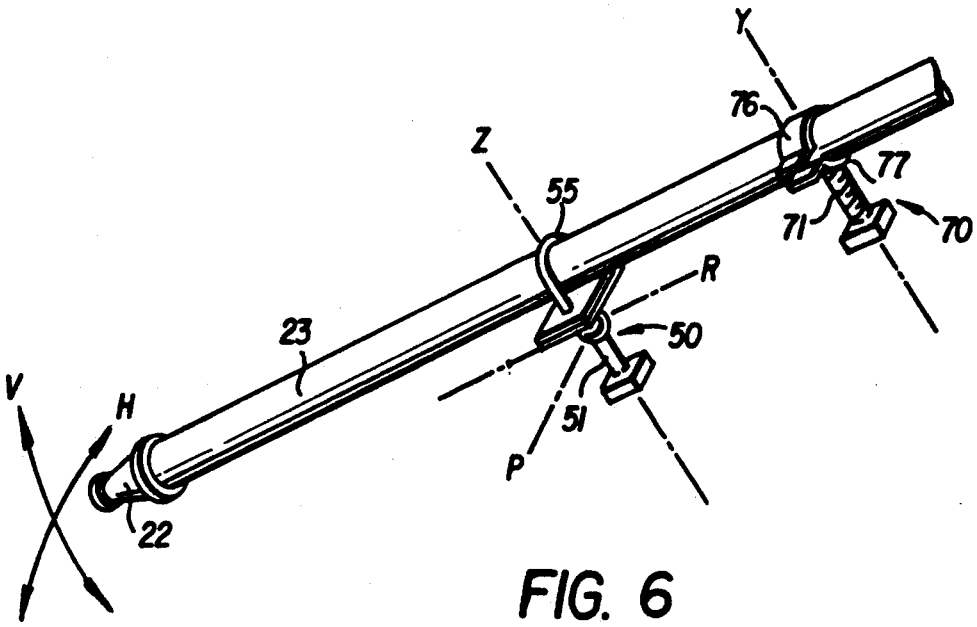
FIG. 6 is a schematic of the present invention wand anchors.

Fixture 50 is a universal joint having three articulation axes P, R and Z (see FIG. 6). In the preferred embodiment of the invention, this universal joint fixture 50 is an automotive suspension type of ball joint having a solid sphere section (not shown) secured to the distal end of a pedestal 51. A Cardan type joint may also be used. A Cardan joint comprises two U joints pivotally connected to respectively opposite pairs of cross yoke arms.

The spherical socket (not shown) surrounding the solid sphere of a ball joint is located within a socket housing 52. A flange 53 joins the two housing segments for assembly around the solid sphere. To the upper housing segment, a pipe saddle 54 is attached by means of a threaded stud passing through the flange 53. Oriented transversely of the pipe, a U-clamp or strap 55 is also anchored through the ball joint housing flange 53.

Figure 5:
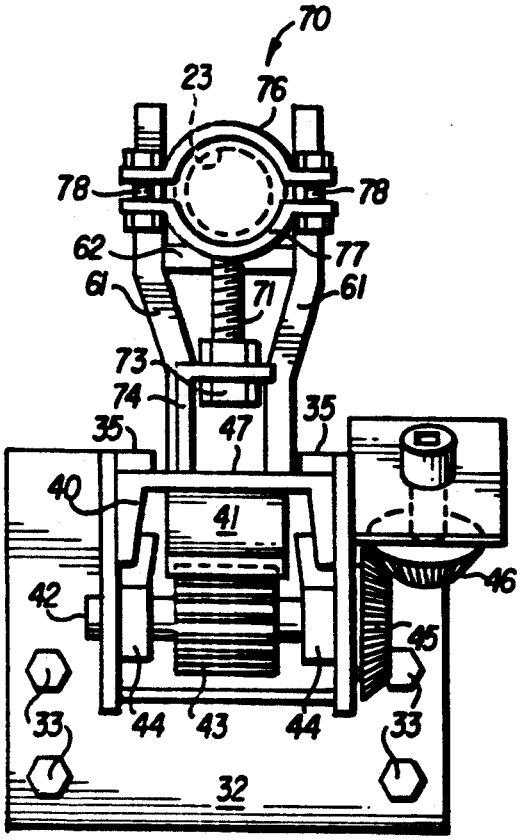
FIG. 5 is a top view of the present invention.

Fixture 60 is a yoke structure comprising two uprights 61 and a cross bar 62 as seen from FIG. 5. The spray wand 23 is not anchored to the fixture 60 but is loosely saddled between the yoke uprights to rest on cross bar 62.

Fixture 70 includes an axially adjustable pedestal 71 for a split pipe clamp. Axial adjustment is achieved by removing the wand 23 from between the clamp halves 76 and 77 held together by cap screws 78 and rotating the threaded pedestal 71 within an anchor nut 73 welded to a bracket 74. A lock nut 75 secures the pedestal in the selected position.

Relevant to the invention understanding is the unyielding axial relationship between spray wand 23 and the steam supply conduit 24. Although the conduit 24 is frequently fabricated from "flexible" hose, the degree of flexibility is small and limited to transverse bending of the hose axis. In assembly, the wand 23 has no significant axial rotation freedom relative to the conduit 24 axis. These mechanical relationships bear upon the invention operation of a lateral adjustment in the horizontal plane about vertical axis Y through the fixture 70 as represented by the arc of vector H of FIG. 6. In this case, the U-clamp 55 of fixture 50 is released to permit the socket housing 52 to roll about the axis R. Since the wand 23 has no axial rotation consequential angular displacement must occur between the wand 23 and clamp 55 structure as the wand is laterally displaced from the vertical plane defined by axes R and Z. Once the desired lateral alignment is attained, that position is held by retightening the U-clamp 55.

Vertical pitch of the wand axis about the fixture 50 axis P is achieved by adjusting the axial length of fixture 70 pedestal 71.

Fixture 60 serves predominately as a displacement limit fence to confine the shatter spray to a predetermined zone in the event that one of the fixture clamps slip.

Notwithstanding the positional adjustment provided by fixtures 50 and 70, most shatter spray position corrections will be made by the rack and pinion drive of channel beam 40.

Most changes in the smelt flow stream 16 position occur within the vertical plane including the channel axis of spout 15: basically, how far the flow stream 16 is launched from the discharge end of spout 15. By locating the axis of channel beam 40 within the same vertical plane of the spout 15 channel axis, simple smelt flow rate variations may be accommodated by rotation of the pinion 43 drive crankshaft 48 to displace the steam nozzle 22 toward or away from the free falling smelt flow stream 16 for maximum dispersion.

Having fully described our invention, obvious alternatives and mechanical equivalents will readily occur to those of ordinary skill in the art. As our invention, however,

We claim:

1. An appliance for mounting a smelt shattering spray conduit on support structure associated with a chemical recovery boiler having a furnace bed and dissolving tank, said furnace bed being drained of accumulated liquid smelt through perimeter spouts which channel a liquid smelt flow stream into a free fall space above said dissolving tank, said appliance for mounting said conduit comprising:

unitizing frame means for securing said appliance to said support structure in the proximity of said smelt free fall flow space, said frame means including platform guide means secured thereto;

a fixture platform confined by said platform guide means to linear translational movement relative to said frame means in a directional line projected through the space normally occupied by said free falling smelt flow stream;

drive means respective to said fixture platform for controllably displacing and securing a stationary position for said fixture platform along said platform guide means;

a first anchor fixture secured to said fixture platform for rigidly holding a smelt shattering spray conduit at a position displaced from said fixture platform said first anchor fixture having at least two pivot axes between said platform and said conduit, a first of said two pivot axes being substantially parallel with said platform translation direction line and a second of said two pivot axes being substantially normal to said first pivot axis; and, a second anchor fixture secured to said fixture platform at a position displaced from said first anchor fixture along a line substantially parallel with said translation direction line, said second anchor fixture having means to rigidly hold said smelt shattering spray conduit at a selectively adjustable position displaced from said fixture platform along a line substantially normal to said first and second pivot axes and pivotable about a third axis coinciding with said conduit position displacement line.

2. An appliance as described by claim 1 wherein said drive means comprises a gear rack secured to said fixture platform along a line substantially parallel with said translation direction line, said gear rack being engaged by manually rotated gear pinion means.

3. An appliance as described by claim 1 wherein said first anchor fixture comprises a universal joint.

4. An appliance as described by claim 3 wherein said universal joint is a ball and socket type joint.

5. An appliance as described by claim 3 wherein said universal joint is a Cardan type joint.

6. An appliance as described by claim 3 having saddle means secured to said universal joint for rigidly holding said shattering spray conduit.

7. An appliance as described by claim 3 wherein said second anchor fixture comprises a conduit clamp secured to a threaded rod pedestal adjustably confined to linear displacement along an axis of said threaded rod pedestal by bracket means rigidly secured to said fixture platform.

8. A chemical recovery boiling comprising a furnace bed for accumulating liquid smelt which is drained from said bed through spouts around a bed perimeter, said spouts channeling respective liquid smelt flow streams into a free fall space above a dissolving tank, said boiler having platform guide means respective to a smelt spout secured to support structure associated with said boiler; fixture platform means confined by said guide means to linear translational movement oriented along a directional line projected through the space normally occupied by said free falling smelt flow stream; drive means respective to said fixture platform means for controllably displacing and securing a stationary position for said fixture platform means along said guide means; first fixture means secured to said fixture platform means for rigidly holding a smelt shattering spray conduit at a position displaced from said fixture platform means, said first fixture means having at least two pivot axes between said platform fixture means and said conduit, a first pivot axis being substantially parallel with said platform translation direction line and a second pivot axis being substantially normal to said first pivot axis; and, a second fixture means secured to said fixture platform means at a position displaced from said first fixture means along a line substantially parallel with said translation direction line, said second fixture means having clamping means to rigidly hold said smelt shattering spray conduit at a selectively adjustable position displaced from said fixture platform means along a line substantially normal to said first and second pivot axes and pivotable about a third axis coinciding with said conduit position displacement line.

9. A recovery boiler as described by claim 8 wherein said drive means comprises a gear rack secured to said platform means along a line substantially parallel with said translation direction line, said gear rack being engaged by manually rotated gear pinion means.

10. A recovery boiler as described by claim 8 wherein said first fixture means comprises a universal joint having at least two axes of pivotal freedom.

11. A recovery boiler as described by claim 10 wherein said universal joint is a ball and socket type joint.

12. A recovery boiler as described by claim 10 wherein said universal joint is a Cardan type joint.

13. A recovery boiler as described by claim 10 wherein said universal joint includes saddle means for positionally securing said spray conduit thereto.

14. A recovery boiler as described by claim 8 wherein said second fixture means comprises a conduit clamp secured to a threaded rod pedestal adjustably confined to linear displacement along an axis of said threaded rod pedestal by bracket means rigidly secured to said platform means.

* * * * *